US010791838B2

(12) United States Patent
Pacific et al.

(10) Patent No.: US 10,791,838 B2
(45) Date of Patent: Oct. 6, 2020

(54) PORTABLE SEAT APPARATUS AND METHOD

(71) Applicants: John Pacific, San Diego, CA (US); James William Condry, Westford, MA (US)

(72) Inventors: John Pacific, San Diego, CA (US); James William Condry, Westford, MA (US)

( * ) Notice: Subject to any disclaimer, the term of this patent is extended or adjusted under 35 U.S.C. 154(b) by 0 days.

(21) Appl. No.: 16/122,763

(22) Filed: Sep. 5, 2018

(65) Prior Publication Data

US 2019/0038028 A1 Feb. 7, 2019

Related U.S. Application Data

(63) Continuation of application No. 15/006,141, filed on Jan. 26, 2016.

(60) Provisional application No. 62/108,343, filed on Jan. 27, 2015.

(51) Int. Cl.

| | |
|---|---|
| ***A47C 4/02*** | (2006.01) |
| ***A47C 4/03*** | (2006.01) |
| ***A47C 3/025*** | (2006.01) |
| ***A47C 11/00*** | (2006.01) |
| ***G09F 23/00*** | (2006.01) |

(52) U.S. Cl.

CPC ..... *A47C 4/02* (2013.01); *A47C 3/0255* (2013.01); *A47C 4/03* (2013.01); *A47C 11/00* (2013.01); *G09F 2023/005* (2013.01)

(58) Field of Classification Search

CPC ..... A47C 4/02

See application file for complete search history.

(56) References Cited

U.S. PATENT DOCUMENTS

| | | | | | |
|---|---|---|---|---|---|
| 1,395,153 | A | * | 10/1921 | Schomacker | A47C 7/62 40/320 |
| 1,786,123 | A | * | 12/1930 | Murphy | A47C 7/64 40/320 |
| 2,711,786 | A | * | 6/1955 | Weiss | A47C 11/00 297/452.14 |
| 3,283,433 | A | * | 11/1966 | Navarino | G09F 3/00 40/320 |
| 4,717,202 | A | | 1/1988 | Batchelder, III et al. | |
| 5,329,716 | A | * | 7/1994 | Fite | A47C 7/725 136/291 |
| 5,356,204 | A | * | 10/1994 | McDonough | A47D 1/006 297/181 |

(Continued)

*Primary Examiner* — David R Dunn
*Assistant Examiner* — Tania Abraham
(74) *Attorney, Agent, or Firm* — John C Merchant

(57) ABSTRACT

A portable seating apparatus and method for easy assembly/disassembly of the same is described. The apparatus is designed for easy display of theme based design components which may be easily changed with minimal effort and complication. The assembly includes standing and swing type embodiments. The apparatus comprises seat, side support, and back rest components. The seat component generally comprises one or more substantially horizontal seat members and a front facing frontboard member to be removably attached with the front of the seat component. Right and left side support components include integral seat support, arm rest and back rest support portions. The backrest component includes at least one backboard member.

14 Claims, 11 Drawing Sheets

(56) References Cited

U.S. PATENT DOCUMENTS

| | | | | |
|---|---|---|---|---|
| 5,683,137 | A * | 11/1997 | McDonald | A47D 15/00 297/188.09 |
| 5,738,414 | A | 4/1998 | Wieland et al. | |
| 6,241,317 | B1 | 6/2001 | Wu | |
| 6,644,750 | B1 | 11/2003 | Sandman et al. | |
| 6,695,401 | B1 | 2/2004 | Noll | |
| 6,942,298 | B2 | 9/2005 | Harrison | |
| 7,722,123 | B2 | 5/2010 | Holland | |
| 8,128,173 | B2 | 3/2012 | Huang | |
| 8,393,676 | B2 | 3/2013 | Hill | |
| D688,076 | S * | 8/2013 | Lee | D6/366 |
| 8,646,843 | B2 | 2/2014 | Koch | |
| 8,833,271 | B2 | 9/2014 | Everett | |

* cited by examiner

PORTABLE SEAT APPARATUS AND METHOD

CROSS-REFERENCE TO RELATED APPLICATIONS

The present continuation application claims the benefit of a commonly assigned nonprovisional parent application having Ser. No. 15/006,141 filed Jan. 26, 2016 and the provisional application having Ser. No. 62108343, filed on Jan. 27, 2015 and entitled CUSTOM BENCHES AND PORCH SWINGS, which applications are incorporated herein by reference in their entirety.

BACKGROUND OF THE INVENTION

1. Field of the Invention

The present invention is in the field of portable furniture and pertains particularly to methods and apparatus for assembling and using a theme swappable portable seat or bench.

2. Discussion of the State of the Art

In the field of portable and lightweight furniture, there are a variety of light weight seating apparatus that may be folded and ported to an event like a sporting event, pool party, music concert, or other types of events. These may include frame and fabric apparatus, typically referred to as lawn chairs, stadium seats (folded fabric chairs), etc. Typically, such items may include a theme illustrated as graphics on a viewable part of the apparatus. A challenge with a single themed apparatus is that it is limited relative to different themed events and one cannot easily change the theme of the apparatus for different types of events.

Such themed seating apparatus are typically single user seating apparatus and only seat one person. It may be difficult to provide enough seating for a large group of people at various outdoor activities such as picnics, sporting events, tailgate parties, and other such activities. It may also be difficult to transport conventional themed folding chairs, and other types of folding chairs which may be flimsy or unstable for some users. Moreover, it may be desirable in the art to have a light weight seating utility that may be easily stowed, ported, and assembled for use in the field wherein the seat may accommodate more than a single user.

Therefore, what is needed in the art is a seating apparatus that solves the above challenges in the art.

BRIEF SUMMARY OF THE INVENTION

An easily stowed, ported and assembled seating apparatus and method for assembling/disassembling the same is described. The apparatus includes a bench type seat for one or more persons including seat, side support, and back rest components. Outward facing components may include theme ornamentation (for example a seasonal theme such as Christmas, Halloween etc. or sports theme such as designs representing a football theme or specific team or other non-theme design ornamentation. The apparatus may be easily disassembled, stowed, moved, and reassembled without significant difficulty or use of complex tools. Assembly embodiments include those having legs which are designed to stand directly on the ground or other substantially horizontal surface as well swing type embodiments designed to be suspended from a frame or other support member.

The seat component generally comprises one or more substantially horizontal seat members and a front faceplate member which is removably attached with the front of the seat component. Right and left side support components include integral seat support, arm rest and back rest support portions. By swapping side support components having legs with side support components having no legs, the apparatus can be easily changed from a standing type embodiment to a suspended (swinging type) embodiment. Some embodiments include side support components having both inside and outside side support members where the inside side support member may attach with the seat component and the corresponding outside side support member may have design elements. The outside support member is removably attached to the inside side support member allowing the design elements of the outside support member to be easily changed without detaching the inside side support member from the seat component. Some embodiments include a back rest component having inside and outside backboard members wherein the outside backboard member (i.e. that member facing away from the seated area) is connected with the right and left side support components to provide structural stability and the inside backboard member (i.e. the member coming against which the back of the user rests) include design elements. The inside backboard member having particular design elements (theme elements for example) may be easily detached from the outside backboard member and replaced with a different inside backboard support member having different design elements without detaching the outside backboard member from the right and left side support components.

Example methods for assembling/disassembling both standing and suspended (i.e. swinging) bench type apparatus are described. An example method for assembly of the standing embodiment of the seat apparatus includes steps for gathering components, aligning the seat components with inside right and left side support component members and attaching the right and left inside side support members to the seat component using fasteners, standing the bench upright, aligning and attaching an inside backboard member to an outside structural backboard member to form a back rest component and attaching the back rest component with the right and left side support components using fasteners. An example method for assembly of a suspended (swing type) embodiment of the seat apparatus includes steps for gathering components aligning the seat components with inside right and left side support component members and attaching the right and left inside side support members to the seat component using fasteners, positioning suspension frame, attaching suspension means (such as hanging chains, cables or straps) to right and left side support components, suspending assembly from frame, aligning and attaching an inside backboard member to an outside structural backboard member to form a back rest component and attaching the back rest component with the right and left side support components using fasteners. Disassembly of both standing and swinging type seat apparatus includes reversing the respective steps described above.

DETAILED DESCRIPTION OF THE INVENTION

The inventor provides a unique modular themed bench that is easily disassembled, ported, and assembled wherein the theme may be easily and manually changed by swapping specific bench component members with other bench component members presenting alternate or other theme graphics and or design elements. The present invention is described in enabling detail using the following examples, which may describe more than one relevant embodiment falling within the scope of the present invention.

Figure 1:
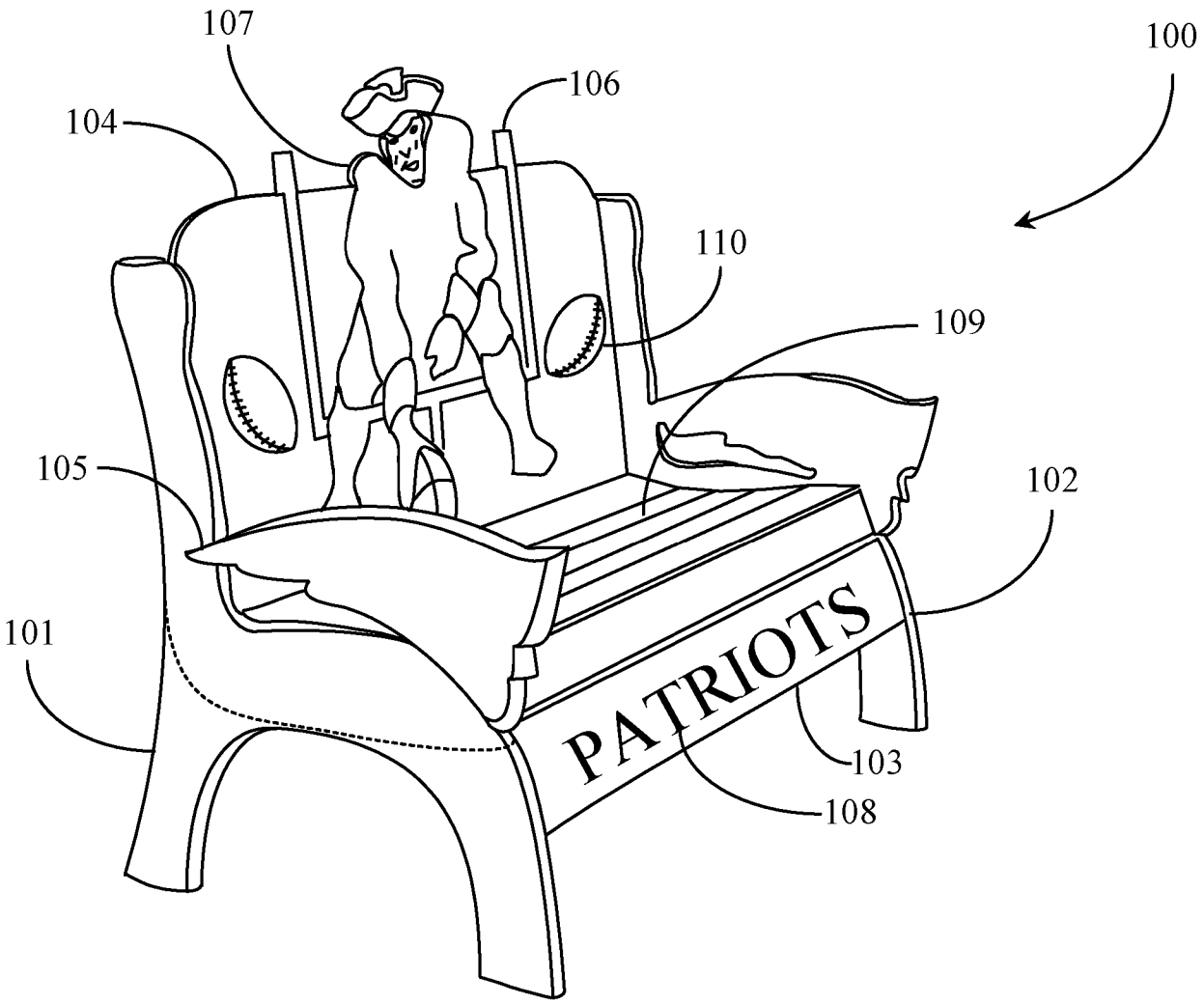
FIG. 1 is a perspective view of a portable standing bench system having components presenting theme graphics and theme shapes according to an embodiment of the present invention.

FIG. 1 is a perspective view of a portable bench 100 with components (or specific members of those components) presenting theme graphics and theme shapes according to an embodiment of the present invention. Bench 100 is a portable bench having modular components that may be quickly and easily assembled and disassembled. Bench 100 includes a seat component comprising a bench style seat frame (not illustrated) and a plurality of seat board members (or slats) 109 that may depict theme graphics though no graphics are illustrated on the seat board members in this example. Given the primary theme of a football team in this example, the seat board members 109 might be themed according to a football gridiron or field for example.

Bench 100 includes left and right side support components—left side support component 101 and a like right side support component 102. Side support components 101 and 102 may include theme graphics and or theme shapes. In this example, a theme shape 105 is incorporated into side support components 101 and 102, the shape being a depiction of the NFL logo of the New England Patriots football team. Football is merely an example of one possible theme that bench 100 may represent. One with skill in the art will appreciate that the number of possible differing themes that might be implemented in a bench such as bench 100 are without limit. At least three differing themes are described in this specification and are deemed sufficient for discussion purposes. One will note that the design elements of the various components described and shown may include flat decals, painted designs, three dimensional shapes or both. Further design elements may consist of additional add-on or snap on shapes that are attached with the components and which, themselves, may be easily removed or swapped with different shapes.

In one embodiment, the right and left side support components 101 and 102 are assembled components each comprising inside and outside members that fit together and may be fastened together to form the side support component for the left side and the side support component for the right side. More detail about integral parts (or portions) of side support components 101 and 102 is provided later in this specification. In one embodiment, the side support components may be single board members or molded parts without departing from the spirit and scope of the present invention.

Bench 100 may include a frontboard member 103 that may connect with the front edge of the seat component and/or at the inside surface of each of the right and left side support components. Frontboard member 103 is optional and is not required to practice the present invention. In this example, front board member 103 has themed design elements (in this case graphics) in the form of signage specifically identifying the NFL team (Patriots) that consistent with the theme represented by this embodiment of the bench apparatus. Frontboard 103 may be removed and replaced by another frontboard having a different theme design elements such as graphics or signage referring to an alternate team. In one embodiment frontboard member 103 may comprise two integral pieces such as a structural component and a faceplate theme member that may be easily removed and replaced.

Bench 100 includes a bench style backrest component 104. Backrest component 104 may be easily assembled onto bench 100, typically after the side support components have been assembled to the bench seat. Backrest component 104 includes theme design elements (in this case three dimensional graphic representations) depicting a football mascot (in this case a Patriot) 107 situated in front of a goal post 106 and flanked by footballs 110. In this example, the backrest component 104 and right and left side support components 101 and 102 include preformed or fabricated shapes that specifically identify the subject of the theme. In one implementation the backrest component is a two-piece component similar to the two piece side support components described further above. More particularly, backrest component 104 may comprise two substantially planer (though they may be curved or molded to be more comfortable for the user) members that may be fastened together wherein the inside member (referred to herein as the inside backboard member) contains the theme design elements and the outside member (not shown but positioned parallel and adjacent with the inside back board member) which primarily serves as a structural support bridging the right and left side support components but which may also provide design elements at the outside (back facing) surface as well. In the case of theme shapes, both pieces may conform to a cut pattern of shapes without departing from the spirit and scope of the present invention. However, the outside backboard member is more likely to remain theme neutral and the inside backboard member is more likely to contain theme elements. More detail regarding the backboard component is provided later in this specification.

In one embodiment of the present invention, bench 100 is fabricated of wood components. In another embodiment, bench 100 may be fabricated of molded UV resistant poly vinyl chloride (PVC) or other polymer-based components that may be provided separately to be alternately assembled to a same bench seat assembly. In further embodiments, other materials known to the art may be utilized to form all or a portion of the components described including materials such as light weight sheet metal, structural foam or hard rubber, particle board and other materials used in the construction of portable light weight furniture. In one embodiment, the components of bench 100 are pre-drilled for fasteners and are fastened together using an assortment of lag bolt fasteners. In an alternative embodiment, bench components may be fastened together using magnetic pin seats and metal rods or dowels having a high attraction to a rare earth magnet. In still another embodiment the components may be molded components (for example, having male/female fasteners) that may be removably snapped together or pulled apart. Clips, straps with snap fasteners, and other fastener types (for example tongue and groove methods) may be used to removably fasten the components together.

It is noted herein that the left and right side support components 101 and 102 include integral arm rest portion, seat support portion, backrest support portion and (in the case of a standing embodiment) front and back legs as shown in bench 100. Alternatively, the side support component may extend from the seat support portion all the way to the ground as a single plane. It is also noted herein that backrest component 110 has a "physically implemented" goal post 106 and mascot 107 where portions of those are represented by shapes that extends above the top horizontal line of the backrest wherein the rest of the theme item may be painted onto the inside surface of the backrest component and wherein the theme item may incorporate a portion of the backrest component to support the particular shapes. However, this is not specifically required to practice the present invention as alternate backrest components and side support components may vary widely in design, some being identical save for painted or otherwise applied flat graphics. In still another embodiment, some of the graphics may be two or three dimensional molded or shaped graphics.

In general use of the present invention, a user may obtain through purchase or other means a kit that includes a fully assembled seat component (assembly) leaving the swappable components to the backrest component 104, right and left side support components 101 and 102, and the frontboard 103 which may itself contain signage, graphic or other design elements. As shown, the frontboard 103 has a removably mounted faceplate 108 covering the front board 103 which faceplate 108 contains the words "Patriots". In a variation of this embodiment, the seat component members (i.e. the bench slats or boards) 109 may be themed and may be swappable with those depicting alternate theme design elements without departing from the spirit and scope of the present invention. The user may change the theme of the bench 100 at will by removing the components having theme design elements from the preassembled bench seat and replacing them with like components depicting another theme. When porting or transporting bench 100, all or portions may be disassembled until use such as at a tailgate party at a game (for football or other sports). The user may assemble bench 100 on site using simple tools or, in some embodiments, no tools depending on the fastener system type implemented. It should be noted that the term "bench" herein generally refers to the style of the seat apparatus having a substantially horizontal seat attached with a backrest. The present invention is intended to provide seating for one or more users but use of the term "bench" is not intended to limit the invention to excluded chairs or other seating apparatus primarily used for a single person.

Figure 2:
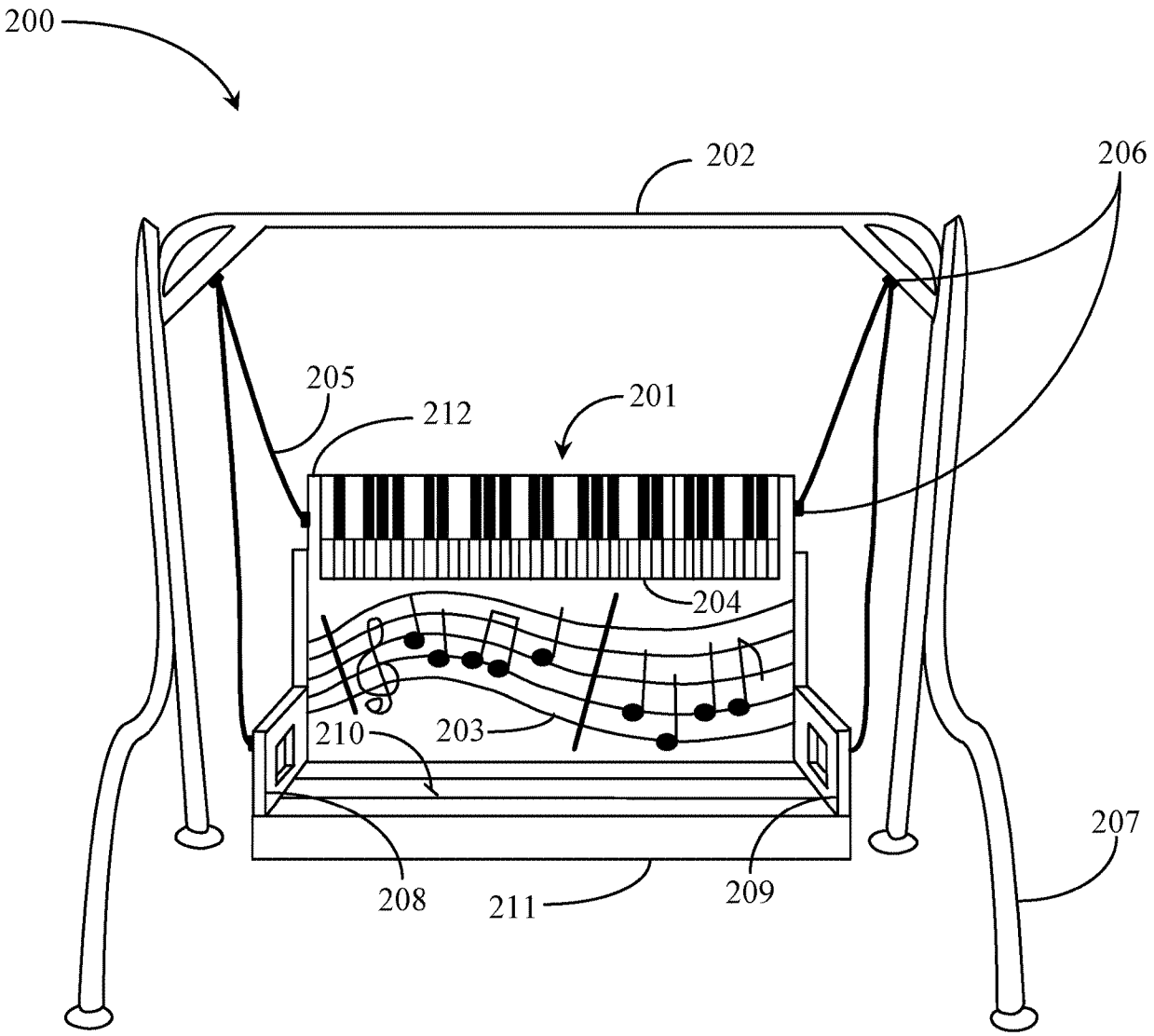
FIG. 2 is a front perspective view of a portable swing type bench system having components presenting theme graphics.

FIG. 2 is a front perspective view of a portable swing type embodiment of a seat assembly 200 having components presenting theme design elements. The swing type seat assembly 200 includes a seat apparatus 201 suspended from a portable suspension frame 202. Seat apparatus 201 includes right side support component 208 and left side support component 209. In this example, side support components 208 and 209 include integral arm rest, seat support, and backrest supports portions but no bench leg portion owing to the fact that the bench is suspended off of the ground making legs unnecessary. Seat apparatus 201 may be suspended from portable suspension frame 202 via a chain, cable, rope, line or such suspension means 205. In the example provided, one or more chains or cables 205 may be implemented at each side of the bench assembly as shown to suspend the bench from the suspension frame 202. In an embodiment where the left and right side support components each comprise integral inside and outside members, the "legs" are confined to the outside member supporting design elements.

Suspension frame 202 may be a portable tubular frame made of steel tubing. In one embodiment, suspension frame 202 may be dissembled and transported in parts for reassembly at a desired location. In one implementation, the seat apparatus 201 may be suspended from any suitable structure such as a porch eve of a house or from a horizontal tree limb, etc. In this example chain or cable attachment fixtures 206 are provided both on frame 202 and seat apparatus 201 at strategic locations to adequately support, balance and provide freedom of forward and backward movement of the seat apparatus 201 relative to the frame 202. In this embodiment, the frame 202 includes four tubular legs 207 having "feet" for stability on a substantially horizontal surface. In alternative embodiments, the frame 202 may have a hoop base or be constructed of wood or other materials having standard vertical side members, legs, feet and optional horizontal cross bracing. In alternative embodiments the backrest support portion, arm rest portion and seat support portion of the right and left side support components may have eye cutouts, extending loops or other means for fastening the support means to the seat apparatus.

In one embodiment frame legs 207 may be telescopic to some degree allowing for leveling purposes. Seat apparatus 201 includes a front board 211, which may depict theme design elements (i.e. graphics and or shapes) although none such elements are depicted here. In alternative embodiments, as shown in FIG. 1, the front board 211 may include an optional faceplate (108 of FIG. 1) containing graphics or other design element. Likewise, side support components 208 and 209 may depict theme design elements. Apparatus 201 also includes a seat component having multiple bench seat boards or slats 210, which also may have theme design elements. Seat apparatus 201 includes a backrest component 212 depicting theme design elements which in this case include a keyboard design 204 and a "flowing" music staff 203. In the embodiment where the backrest 212 component comprises two removably attachable inside and outside backboard members, a user may swap theme by removing the inside backboard member supporting theme design elements and replace it with a different inside backboard member depicting alternate or differing theme design elements.

It is important to note herein that in one implementation a theme bench may be assembled using side support components having no legs for suspension or side support components having legs for standing alone without departing from the spirit and scope of the present invention. As described further above, the backrest component 212 may be swapped out for a like backrest component having design elements depicting an alternate theme that is relevant to music such as one having a "guitar fret" in place of keyboard 204. In another embodiment the swapped design elements may be entirely different from the general category of music such as a holiday theme like Thanksgiving or Valentine's Day, etc.

It is noted herein that the dimensioning of accessory themed components (side support components, backrest components, seat component members (such as slats or boards), and faceplates for assembly to a prefabricated bench seat apparatus are sufficiently identical relative to fastening point locations and alignments thereof for assembly such that the otherwise shape and theme altered components may fit to and be assembled to a single seat apparatus. Bench seat apparatus 201 may be suspended from a porch eave, beam, frame, or some other structure without departing from the spirit and scope of the invention. The provision of a suspension frame like frame 202 supports portability in the swing version of the bench seat apparatus.

Figure 3:
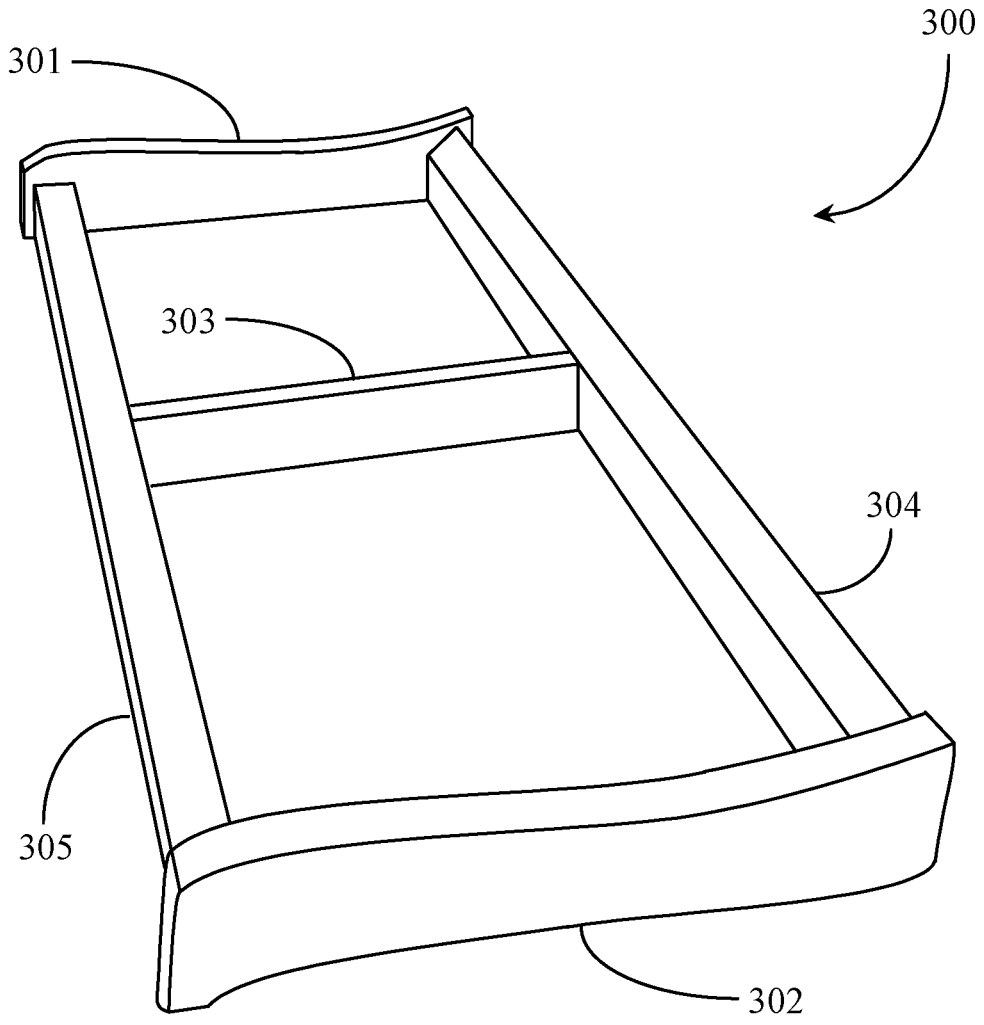
FIG. 3 is a perspective view of a bench seat frame of the bench seat of FIG. 1 or FIG. 2.

FIG. 3 is a perspective view of assembled frame members 300 for an embodiment of the seat component of FIG. 1 or FIG. 2. Frame 300 may be fabricated from wooden frame members using lag bolts as previously described above. Frame 300 may be assumed present in both FIG. 1 and FIG. 2 although it is not visible in those views. Frame 300 includes a seat frame side support member 301 and seat frame side support member 302. Frame 300 also includes opposing elongate front and back seat frame members 305 (front member) and 304 (back member). A center seat frame support member 303 is provided for stability. There may be more than one centrally located seat frame support member than is illustrated in this view without departing from the spirit and scope of the present invention.

In this example, at least the seat frame side support members 301 and 302 are shaped to provide an ergonomic seat surface promoting comfort for a user. Other shaping patterns might be used without departing from the spirit and scope of the invention. In an alternative embodiment, the seat frame side support members are straight and not shaped. In one embodiment seat component frame 300 is assembled at the factory, perhaps including the bench seat surface slats or seat boards. Also in one embodiment, the seat frame 300 is pre-prepared for lag bolt fastening including predrilling and insert of threaded bolt seats or threaded or coiled wire locking inserts if provided (fasteners not illustrated). A strong wood glue may also be used to help hold joints together and to make them permanent so as not to be disassembled by the user. In alternative embodiments, there is no seat component frame at all but instead a single substantially horizontal plank (which may also be curved for ergonomic purposes) is used as a single piece seat component having right, left, front, back, top, and bottom sides.

Figure 4:
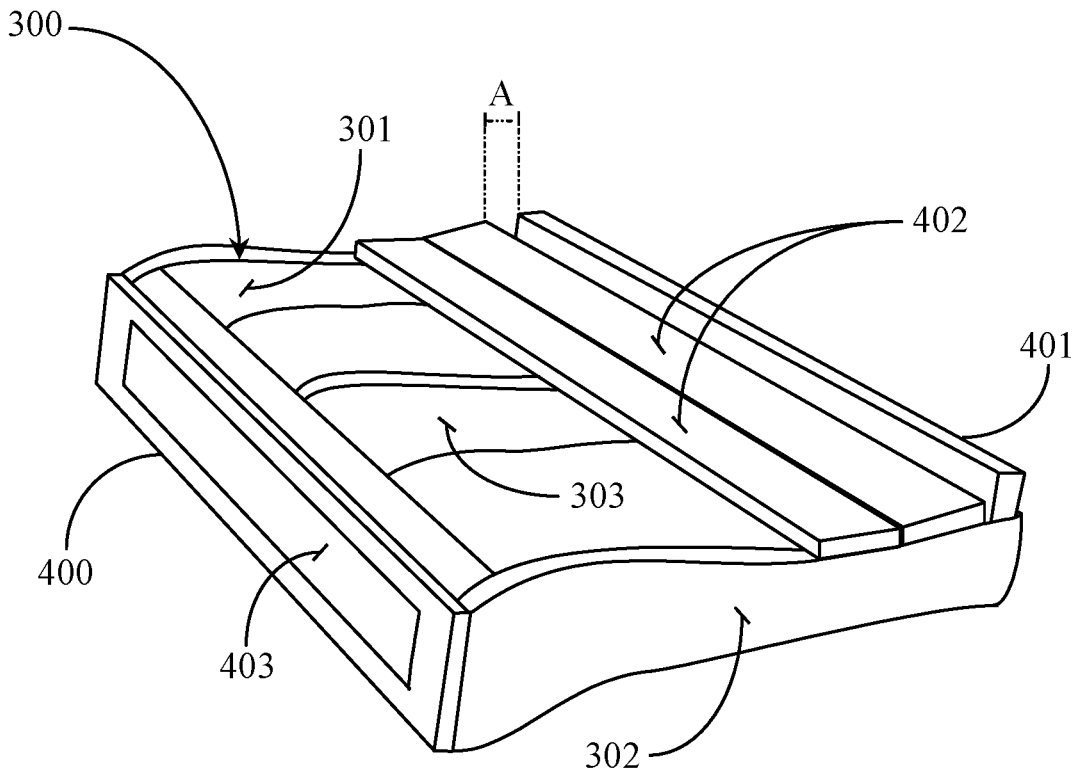
FIG. 4 is a perspective view of the bench frame of FIG. 3 with additional seat members added.

FIG. 4 is a perspective view of the seat component frame of FIG. 3 with additional component members added. Frame 300 is depicted with slatted members 402 analogous to slats or bench seat boards 109 of FIG. 1 or 210 of FIG. 2. In one embodiment these slat members are "swappable" components having theme design elements. In one implementation slats 402 snap onto or are otherwise fastened onto frame members 301, 303, and 302. In this embodiment they may be themed and may be easily removed and replaced with slats depicting an alternate theme. Some slats are not illustrated in this example to enable view of the underlying seat component frame members.

Seat component frame 300 includes a front board having signage 400 which is analogous to board 103 of FIG. 1 or 211 of FIG. 2. In one implementation the slats may be permanently installed and may be glued down or fastened and glued down to frame 300, wherein the backrest side support components and the frontboard (or a faceplate optionally mounted to the frontboard) are the only swappable components with those having other themes. Frame 300 includes a frontboard 400 having a faceplate 403 removably mounted thereon (which itself may include signage or other design elements). Front board 400 may typically be added after the side support components are installed. The embodiment of the frame 300 as shown includes a back rail member 401 set at an angle for interfacing with the backrest component and leaving a gap A of a dimension suitable for function as a seat to accept the bottom edge of the backrest component.

It is noted herein that seat component frame 300 is largely rectangular, however the shape of the frame should not be considered a limitation of the present invention as other shapes such as perhaps an oval or elongate and annular shapes might be incorporated by design. In one implementation, frame 300 is assembled using lag bolts while the "swappable components are fastened using magnetic seats and pins, via snap components, or some other quick-fasten system requiring little or no tools to assemble. As previously noted, front board 400 may include a faceplate 403 (containing signage or other design elements) that is integral with or removably attached with the front surface of the front board 400. In this implementation, the faceplate 403 may be removed from the frontboard 400 and replaced with another faceplate having different design elements.

Figure 5:
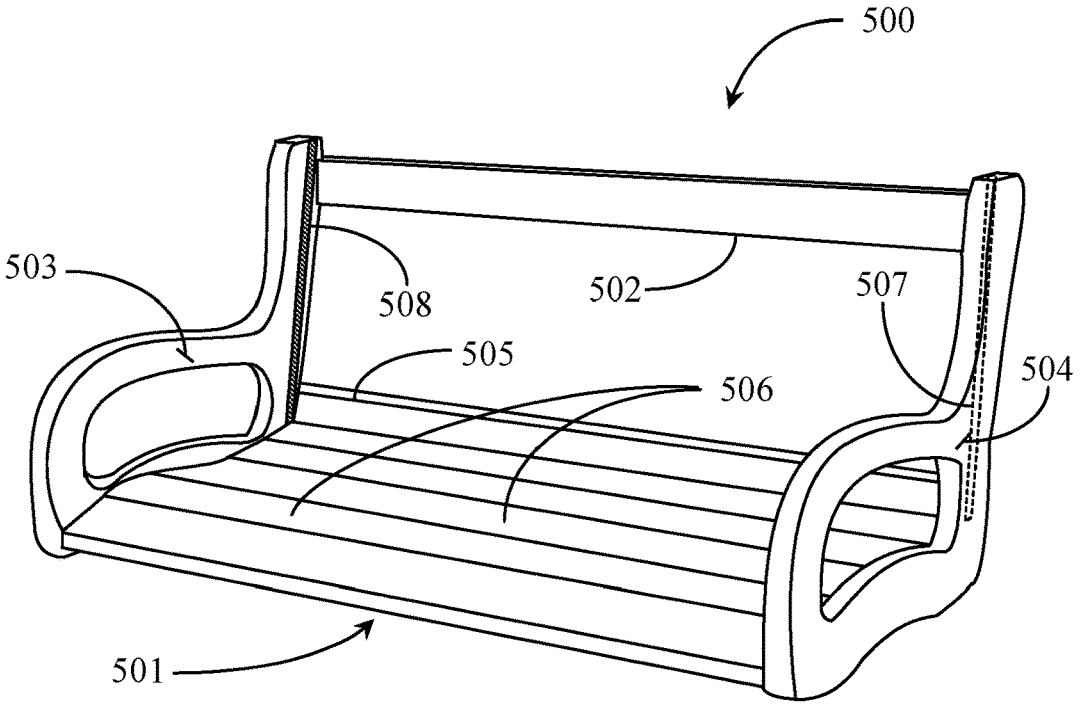
FIG. 5 is a perspective view of a portable bench for suspension by cable or chain.

FIG. 5 is a perspective view of a portable seat apparatus in the shape of swinging bench 500 for suspension by cable or chain. Bench 500 includes a prefabricated seat component assembly 501. In this example the underlying frame is completely covered by bench boards or slats 506 and there is no optional face board. Though not illustrated here slats 506 may depict theme graphics cooperatively such as a grid iron (football) or other theme graphics without departing from the spirit and scope of the invention. In one embodiment, slats 506 have different theme graphics applied to both upper and lower surfaces. In this embodiment a user may remove them and flip them over and reinstall them to change theme of the bench seat surface. In one implementation slats 506 are installed in factory permanently using glue and fasteners such that they are not intended to be removed. In this implementation the theme graphics if any on the slat boards may be generic to an extent that other alternate themes in a same general category of themes may be used. For example, if the slats depict a neutral grid iron, different teams may be represented by the bench using the same slat boards.

Swing bench 500 includes side support component 503 analogous in function to component 208 of FIG. 2, and a side support component 504 analogous in function to side component 209 of FIG. 2. A back rail member 505 analogous to back rail 401 of FIG. 4 is provided to help seat the backboard. In this implementation a backrest component brace member 502 is provided and connected to side support components 503 and 504 at either end of bench 500. The backrest component brace member 502 can be in the form of outside backboard member described above (the difference being that the outside backboard member is a panel that may act as both a back rail 505 and brace member 502). The brace member 502 provides stable support for the backrest component 104 of FIG. 1 or backrest component 212 of FIG. 2. Where a brace member 502 is used, the backrest component is analogous to the inside backboard member described with respect to alternative embodiments described with respect to FIGS. 1 and 2. In one embodiment, a backrest component is inserted into the seat (gap A FIG. 4) created by back rail 505 and then laid back against brace member 502. In one embodiment the backrest support portions of side support components 503 and 504 include elongate slots or grooves that accept the thickness of the backboard component. Right side support component 503 may include slot or groove 508 and left side support component 504 may include a corresponding groove 507 (hidden lines). The width of the corresponding grooves is sufficiently large to accept the thickness of the backboard member (in this case an "inside" backboard member). The angle of the grooves sets the angle of tilt for the backboard. Grooves 508 and 507 may have a depth that extends completely through the inside backboard member of the integral (i.e. duel panel) side support component and perhaps bottoming out at a depth of one half inch or so into the outside integral part of the side component.

In one implementation the backboard may not be "physically attached" to the brace member or to the bench seat assembly. Rather, it may be inserted at the end of the bench assembly process into grooves 508 and 507 and down into the gap left by back rail 505. In one implementation the backboard may be secured to brace member 502 using lag bolts, screws or other fasteners including magnetic fasteners.

Figure 6:
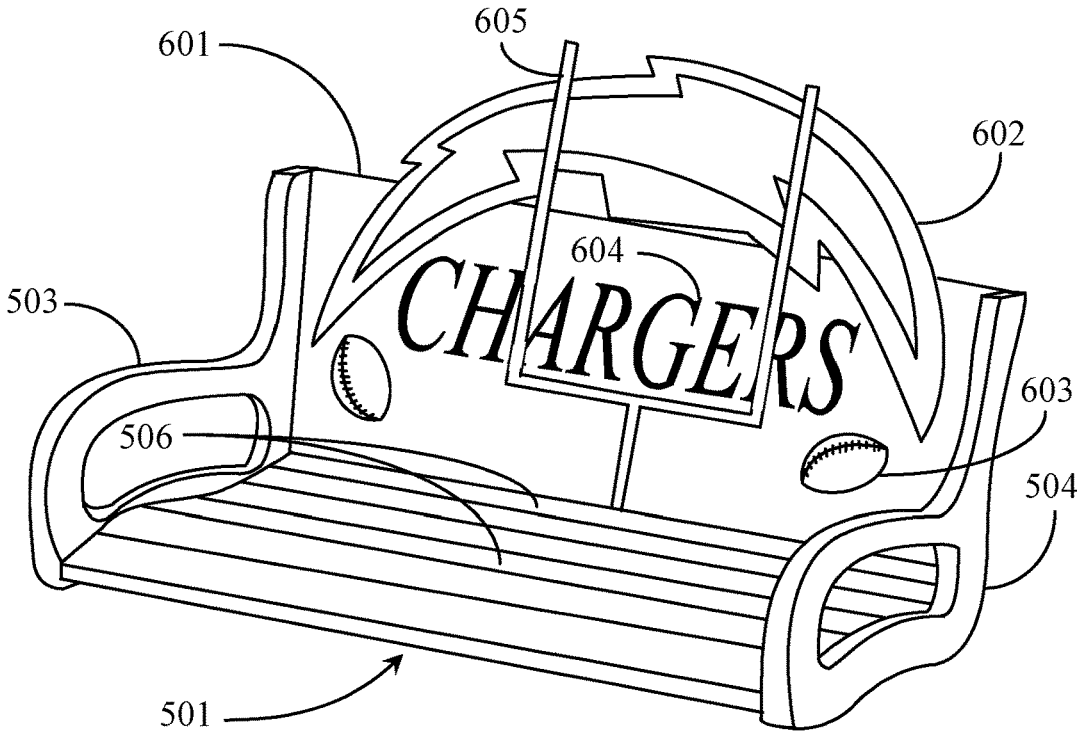
FIG. 6 is a perspective view of bench 500 of FIG. 5 with a backboard 601 presenting theme design elements such as theme graphics and theme shaping according to an embodiment of the present invention.

FIG. 6 is a perspective view of bench 500 of FIG. 5 with a backrest component 601 presenting theme design elements (including graphics and theme shaping) according to an embodiment of the present invention. Backrest 601 comprises an outside backboard component (i.e. the brace 502 of FIG. 5) and an inside backboard component having design elements including theme graphics such as a goal post 605 flanked by footballs 603. A text graphic 604 may be provided that specifically identifies a football team. A team logo 602 (lightning bolt) may be provided that specifically identifies a team (Chargers). In this implementation backrest component 601 includes design elements having at least one theme graphic (604, 603) and a theme graphic shape (605, 602) similar to bench 100 of FIG. 1.

It is noted herein that shaping relative to side support components may vary widely with other side support components so as long as those components fastening alignments are sufficiently the same so that they may be fastened to the seat component (i.e. the bench seat assembly). In one implementation, multiple fastening points may be provided on the seat component wherein a portion thereof accommodates installation of one type of side support component and wherein the other portion thereof accommodates installation of a different type but swappable side support component. In one implementation all of the side support components that are deemed swappable have the same fastening point patterns and align correctly with such point patterns on the seat component to which they are installed. In one implementation theme accessories (none illustrated) may also be provided such as cup holders or can holders that may be themed accordingly and that may be clamped or otherwise quickly attached to a completely seat apparatus.

Figure 7:
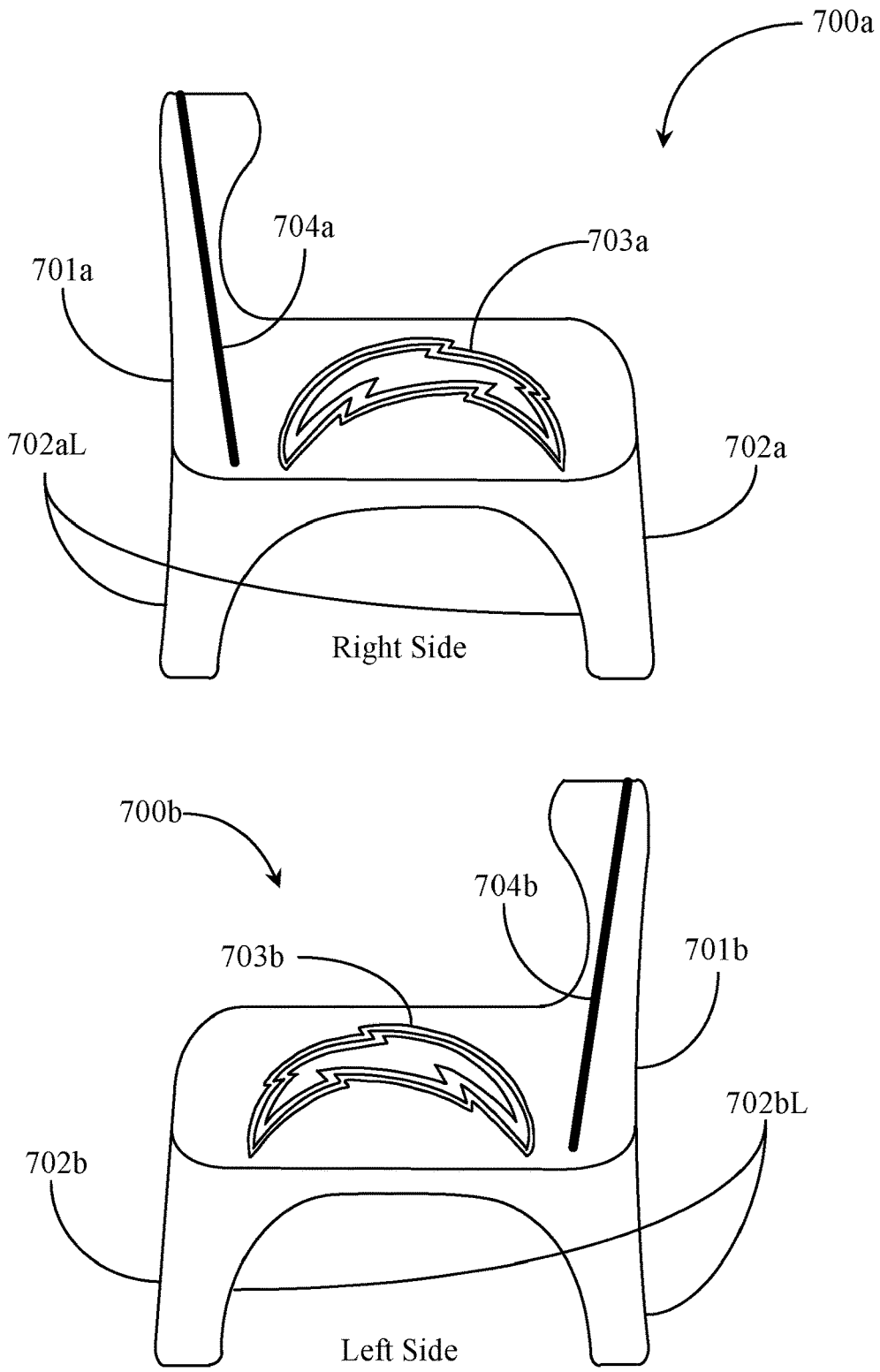
FIG. 7 is a side elevation view of a pair of side support components, the side support components depicting the inside views relative to a bench seat according to an embodiment of the present invention.

FIG. 7 is a side elevation view of a pair of corresponding right and left side support components, the side components depicting the inside views relative to the seat component in an embodiment of the present invention. Side support components 700*a* and 700*b* (right and left) are two-part substantially planer components attached together side by side in this example as was described further above. Side component 700*a* (right side) comprises an inside member 701*a* fastened laminate style to an outside member 702*a*. Outside member 702*a* includes the "legs"702aL of the modular bench. Likewise, side component 700*b* (left side) comprises and inside member 701*b* fastened laminate style to an outside member 702*b* also having legs 702bL. Inside members 701*a* and 701*b* do not include legs and act as structural components that may remain attached with the seat component when a user simply wants to swap themes without disassembly the side support components from the seat component. Therefore, the outside side support members 702*a* and 702*b* may have like counterparts (not illustrated here) that contain no legs and which may be used as the outside side support members having theme design elements fastened to the corresponding inside side support members 701*a* and 701*b* for assembling a swing bench with no legs.

In this example the arm rest portion of the side support component is isolated by a cutout shape 703*a* of a team logo, more particularly a lightning bolt. As shown, the cut-out portion of the feature extends clear through both inside member 701*a* and outside member 702*a*. In this example the cutout is accentuated by a peripheral groove having a width and a depth bounding the cutout and conforming to the shape of the cut out feature. Since the cut out extends through both members 701*a* and 702*a*, the accentuating groove may be duplicated on the outside member 702*a* at the identical location of or in alignment with the peripheral groove on the inside member 701*a*. The same is true for the corresponding side support component 700*b*.

In this implementation, a slot 704*a* is provided through inside member 701*a* extending from the top down to approximately the top surface of the seat component. Slot 704*a* assumes an angle indicating a preferred angle of tilt for the backrest component. Slot 704*a* has a width just large enough to accept the thickness of an inserted backrest component. In one embodiment the backrest component includes an outside (or back) backboard structural panel and an inside (or front) backboard panel having design elements on the front side. In one implementation, slot 704*a* extends in depth past the inside surface of outside member 702*a*.

The left side support component 700*b* may be identical or substantially the same (mirrored image) as right side support component 700*a*. Left side support component 700*b* depicts slot or groove 704*b*, a counterpart of 704*a*. The left side support component includes an outside member 702*b*, and an inside member 701*b*. A cut out 703*b* is substantially identical to the cutout 703*a*. Referring back to component 700*b*, outside side support member 702*b* includes the "legs" 702bL wherein inside member 701*b* does not. Outside support members 702*a* and 702*b* have an upper support surfaces (basically a support ledge) that interfaces with the bottom surface of inside members 701*a* 701*b* thereby lending support for the bench in the standing bench embodiment (i.e. the embodiment having legs). In another embodiment such as a swing bench configuration, outside side support members 702*a* and 702*b* having legs 702aL and 702bL may be replaced with outside side support members having no legs but (like their corresponding outside side support members) also contains the theme design elements (such as theme graphics, shapes etc.) on the outside surface. It should be noted that the inside side support component members 701*a* and 701*b* are substantially planar. The corresponding outside side support component members 702*a* and 702*b* have a substantially planar inside surfaces to substantially conform to the planar outside surface of the corresponding inside side support component members. However, the outside side support component members 702*a* and 702*b* need not have a planer outside surfaces and may instead have design elements which are substantially nonplanar, for example, the outside surface may be rounded or cut into a theme shape (for example, lightning bolts).

Figure 8:
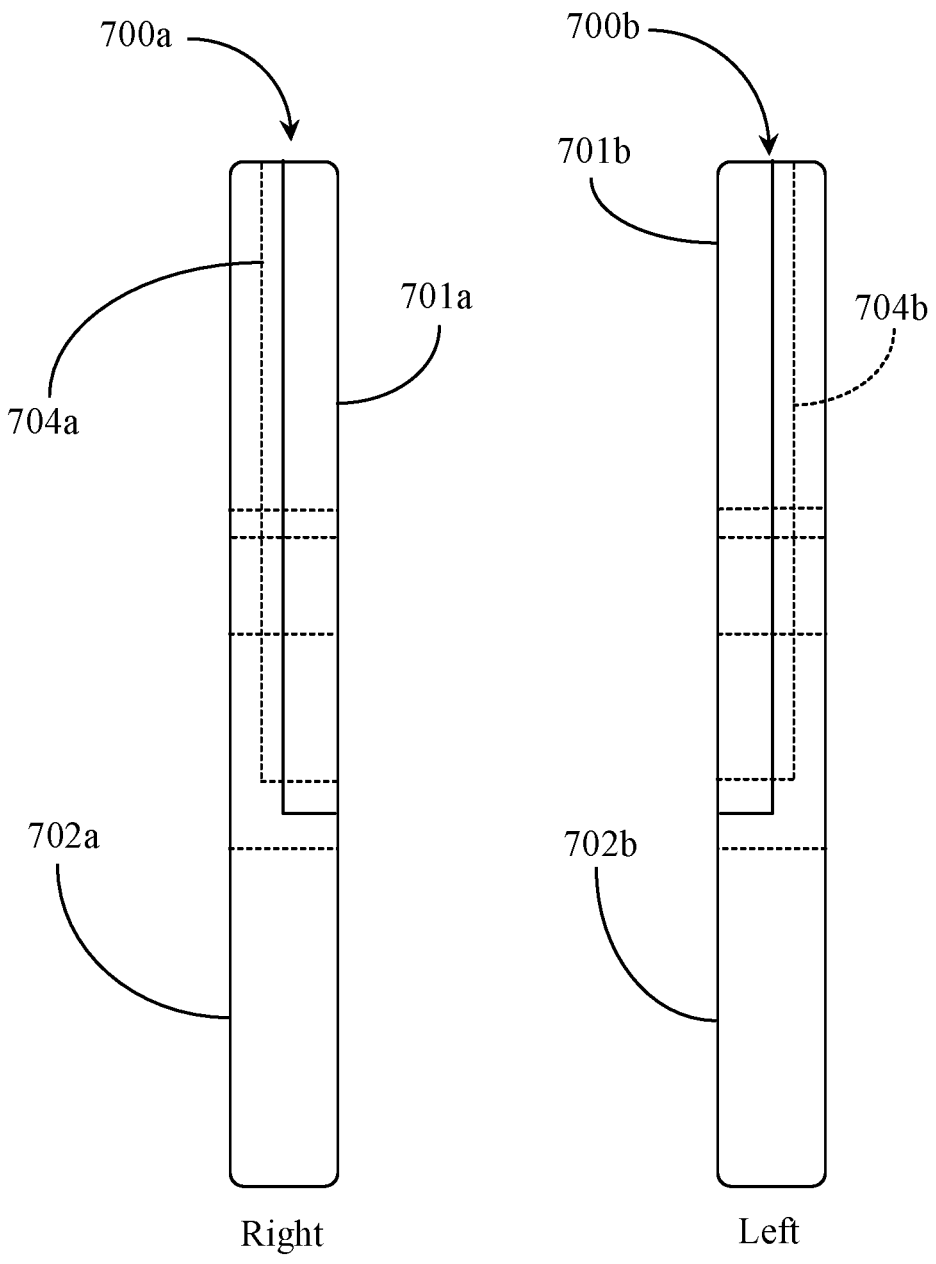
FIG. 8 is a rear elevation view of the side support components of FIG. 7.

FIG. 8 is a rear elevation view of side support components 700*a* and 700*b* of FIG. 7. Inside side support component members 701*a* 701*b* are structural members having no legs and may be securely and removably fastened to the seat component using lag bolts or other secure fastening methods. Note that side support components 700*a* and 700*b* and their respective inside side support members 701*a* and 701*b* as well as their outside side support members 702*a* and 702*b* are depicted in mirror image to one another. Referring to both side support components 700*a* and 700*b*, outside side support members 702*a* and 702*b* may be snapped onto their integral inside side support member counterparts 701*a* and 701*b*. Slots 704*a* and slot 704*b* extend in depth through inside members 701*a* and 701*b* and partially into respective outside members 702*a*, and 702*b*. As shown, the solid lines separate the inside members 701*a* and 701*b* from the corresponding outside members 702*a* and 702*b* of the respective right 700*a* and left 700*b* side support components. The horizontal dotted lines refer to example locations for holes extending through the components to accommodate fastener hardware. Grooves 704*a* and 704*b* are also depicted using dotted lines. One will note that the embodiment of the side support components 700*a* and 700*b* are for a standing bench having legs. Thus, the outside side support component members 702*a* and 702*b* extend below the bottom edge of inside support members 701*a* and 702*a* to form the legs 702aL and 702bL as well as extend inward and under the bottom edge of 701*a* and 701*b* to provide additional structural support to the inside side support component members.

Figure 9:
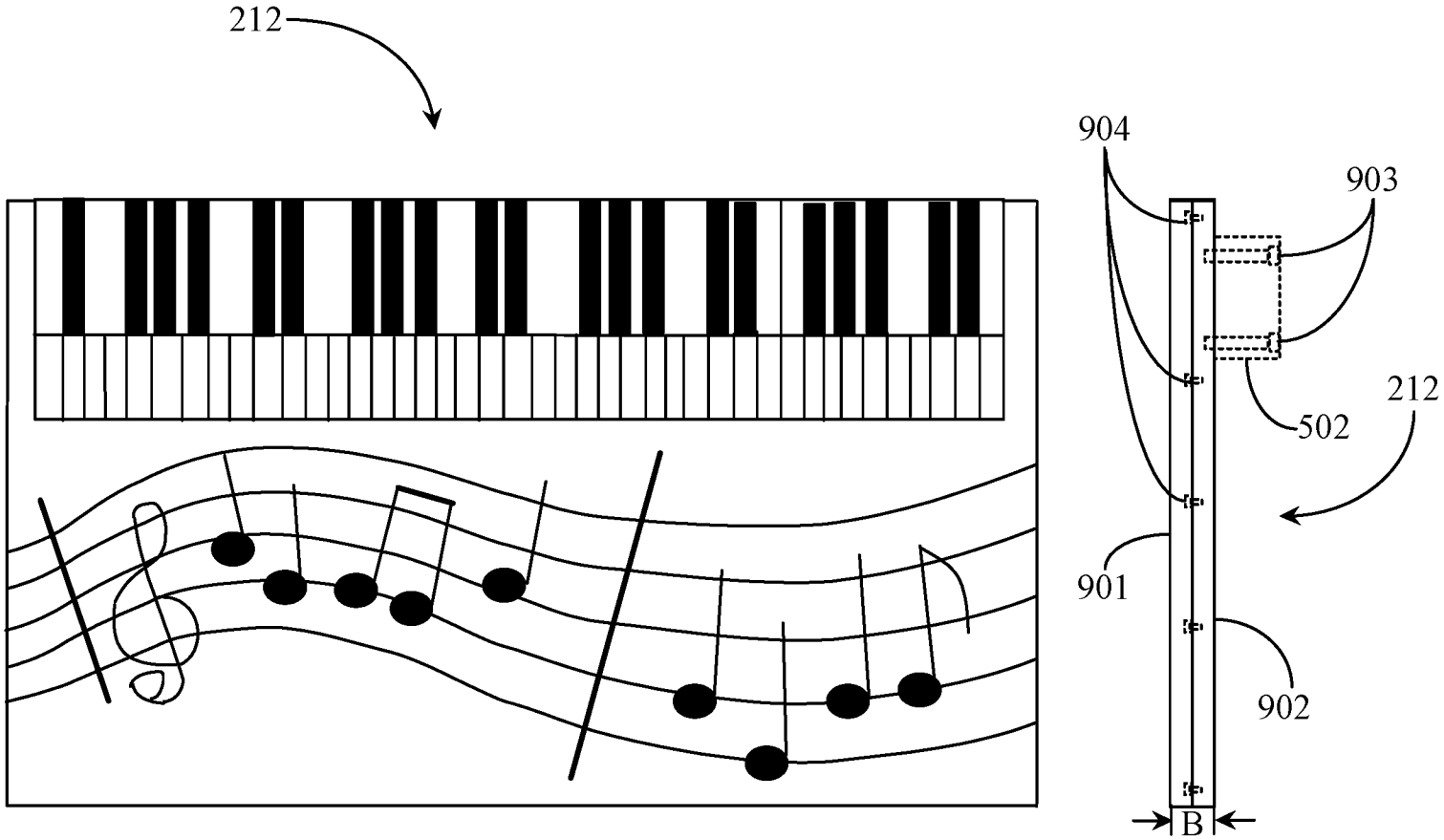
FIG. 9 is a front elevation and side elevation view of backboard member 212 of FIG. 2.

FIG. 9 is a front elevation and side elevation view of backrest component 212 of FIG. 2. The front or "inside" backboard member or "panel" (901 in side view)) of backrest component 212 includes the theme design elements (in this case graphics). An "outside" backboard member 902 serves as a structural member and may not contain any design elements or may contain design elements that are neutral in theme. In this example the inside backboard member 901 may be aligned over and snapped onto the outside backboard member 902 using snap fasteners 904. Other attachment methods may also be used such as press fit pins. In this implementation the inside and outside (i.e. front and back) backboard members are both the same rectangular dimension and snap together to form a thicker backrest component 212. In alternative embodiments the outside backboard member may be a structural member (such as the brace 502 or FIG. 5 and described above) which bridges the right and left side support components to provide structural strength and is not necessarily the same size and dimension as the outside backboard member shown in FIG. 9.

A collective thickness dimension B is just smaller than the grooves through the inside and partially into the outside members of the associated right and left side support components. In the embodiment shown, backboard member 902 is separate from a brace 502 such as that shown in FIG. 5 and is securely fastened to such brace 502 using fasteners such as lag bolts 903. In actual position on a bench, backrest component 212 may angle back as is customary for a backrest of a bench. The inside surface of the backrest component may be molded to improve ergonomic support or comfort of the user. For example, the inside surface of the backrest component (which may be the inside surface of the inside backboard member) can include design elements that are shaped out of cushioning material to increase user comfort and which also include design elements consistent with a theme.

Figure 10:
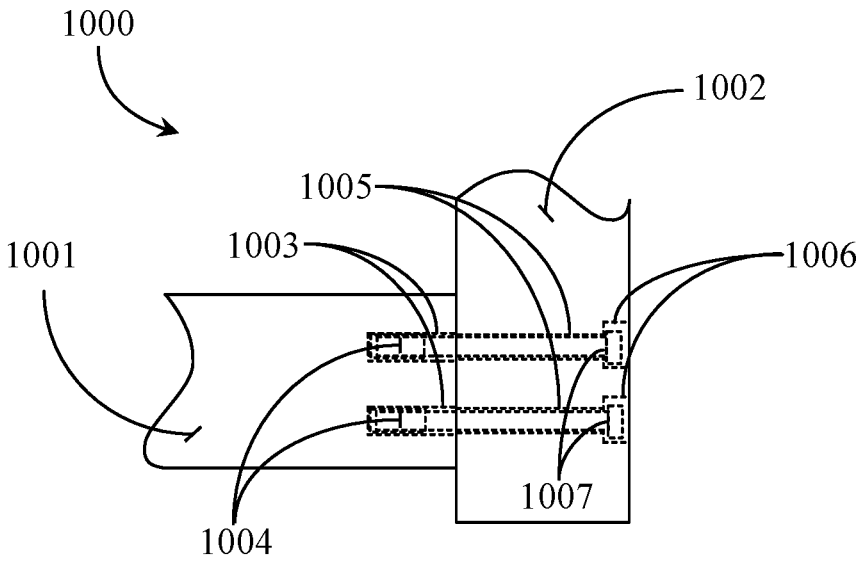
FIG. 10 is an isolation view of a framing joint of the seat apparatus depicting lag joint fasteners.

FIG. 10 is an isolation view of a framing joint 1000 of the seat apparatus depicting lag joint fasteners. Frame joint 1000 may be typical of the frame of the seat component as described previously with frame 300 of FIG. 3. Frame member 1001 may be connected to a frame member 1002 using lag bolt fasteners 1005 and bolt seat inserts 1004. The frame members are pre-drilled for lag bolts including counter bores 1006 that are sufficiently large and at a sufficient depth to accept the lag bolt heads 1007 beneath the surface of the frame member. Lag bolts might be used to secure the structural components (for example the outside backboard member, the left and right inside side support members) to the seat component frame and in assembling the frame of seat component. The components having design elements (for example the outside members of the left and right side support components, the front board, the optional faceplate, and top most signage board if used) may be snapped on rather than requiring tools to install.

Figure 11:
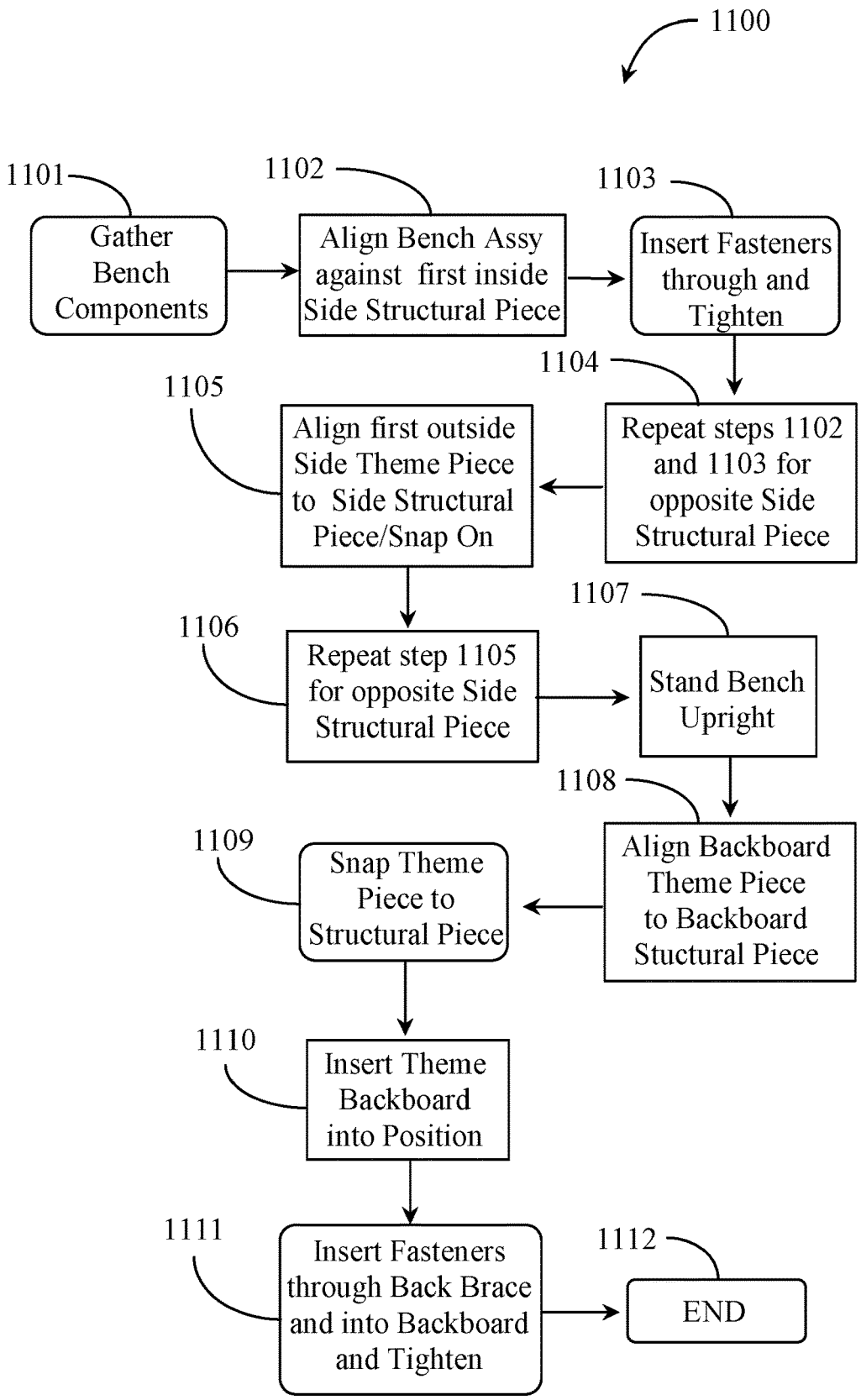
FIG. 11 is a process flow chart depicting steps for assembling a theme bench that stands according to an embodiment of the invention.

FIG. 11 is a process flow chart 1100 depicting steps for assembling a portable seat apparatus that stands according to an embodiment of the invention. Chart 1100 depicts a process beginning with step 1101 gathering all of the apparatus components required to assemble the modular themed bench. This example method pertains specifically to assembly of standing embodiments having inside and outside members combined to make the right and left side support components. In such standing apparatus example, the side support components will include right and left side outside members having legs. In this implementation the seat apparatus includes a seat component having frame and attached bench slat or board members and is factory preassembled as a single seat component.

A user may align the assembled seat component against a first inside side support component member that has no legs and may depict no theme graphics at step 1102. At step 1103 the user may insert fasteners through the seat component frame member and into the inside side support member and tighten the fasteners. At step 1104 the user may repeat steps 1102 and 1103 for the opposing inside side support component member having no legs and no theme design elements. The user may align a first outside side support component member to a corresponding inside side support component member and snap it onto such inside member. At step 1106, the user may repeat step 1105 for the opposite side support component. At this point the seat apparatus may be stood up on the legs at step 1107.

A user may align the inside (or front) backboard member of the backrest component to the outside (or back) backboard member 1108. In this implementation the outside backboard member may have no theme design elements or neutral design elements. At step 1109 the user may snap the inside (design element containing) backboard member to the outside (primarily structural) backboard member using snap fasteners. Other fastening methods (such as those described above) may also be observed without departing from the spirit and scope of the invention.

At step 1110 the user may lift the inside backboard member and insert it into the appropriate position onto the standing seat apparatus such as in grooves at either side support components and a gap running horizontally along the back of the seat component. At step 1111 the user may insert fasteners through appropriate openings through the backboard brace member and may tighten the member to the backrest component. The brace member runs from one side support component to the other and may also be fastened directly to the side support component members. In one implementation the backboard bracing member may be installed between the side support components between step 1107 and step 1108 or between step 1109 and step 1110 without departing from the spirit and scope of the present invention. The process may end at step 1112.

Figure 12:
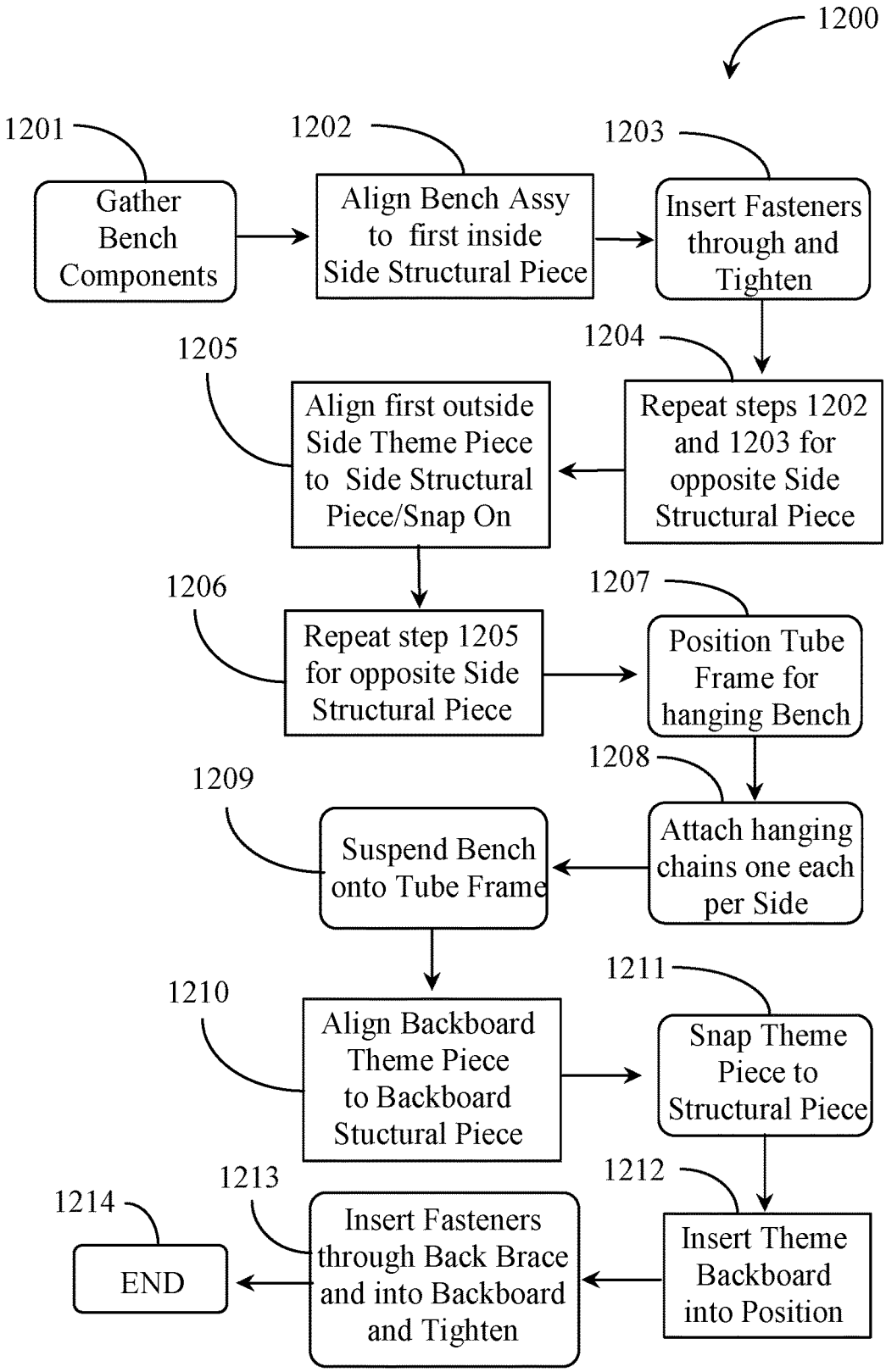
FIG. 12 is a process flow chart 1200 depicting steps for assembling a suspended modular themed bench according to an embodiment of the present invention.

FIG. 12 is a process flow chart 1200 depicting steps for assembling a suspended portable seat apparatus according to an embodiment of the present invention. It is noted herein that steps 1201 through 1206 are identical to steps 1101 through 1106 of FIG. 11 above. In this implementation however, the outside members of the right and left side support components do not have legs as the embodiment of the seat apparatus being assembled is a swing bench.

The user may position a tube frame analogous to frame 202 of FIG. 2. The user may then attach hanging or suspension means such as chains, one chain to each side component of the bench at chain attachment locations. At step 1209, the bench may be suspended from the tube frame.

Steps 1210 through 1213 are identical to steps 1108 through 1111 of FIG. 11. The process may end at step 1214.

It will be apparent to one with skill in the art that the portable easy to assemble modular themed seat apparatus of the present invention may be provided using some or all of the mentioned features, components and component members without departing from the spirit and scope of the present invention. It will also be apparent to the skilled artisan that the embodiments described above are specific examples of a single broader invention that may have greater scope than any of the singular descriptions taught. There may be many alterations made in the descriptions without departing from the spirit and scope of the present invention.

It will also be apparent to the skilled person that the arrangement of elements and functionality for the invention is described in different embodiments in which each is exemplary of an implementation of the invention. These exemplary descriptions do not preclude other implementations and use cases not described in detail. The elements and functions may vary, as there are a variety of ways the hardware may be implemented within the scope of the invention. The invention is limited only by the breadth of the claims below.

What is claimed is:

1. A portable seating apparatus comprising:

a substantially horizontal seat component having opposing right and left sides;

right and left support components, the right support component attached to the right side of the seat component and the left support component attached to the left side of the seat component;

at least one substantially horizontal back brace and a back board member, each having right and left sides, the back board member mounted to the front side of the horizontal back brace;

wherein the right side of the back brace is attached to the right support component, the left side of the back brace is attached to the left support component and the backboard member is removably attached to the back brace enabling the backboard member to be removed and replaced without detaching any other component; and wherein each of the components of the assembly is easily detachable and reattachable to allow for easy disassembly, transport, and reassembly of the apparatus.

2. The seating apparatus of claim 1 wherein the right and left support components include suspension means attached with the left and right side support components to suspend the seating apparatus from a support frame.

3. The seating apparatus of claim 1 wherein the left side support component and the right side support component have legs which extend in a downward direction.

4. The seating apparatus of claim 1 wherein the left side support component and the right side support component are substantially identical.

5. The seating apparatus of claim 4, wherein a portion of each of the right and left support components extend vertically enabling the right support component to fully engage the right side of the backboard member and the left support component to fully engage the left side of the backboard member.

6. The seating apparatus of claim 1 wherein theme design elements are included on a front side of the backboard member.

7. The seating apparatus of claim 1, wherein theme design elements are included on a front board removably attached to a front edge of the horizontal seat component.

8. A seating bench comprising:

a substantially horizontal seat component having opposing right and left sides;

right and left side support components each having integral portions including a seat support portion, and a back rest support portion;

at least one backboard member having opposing right and left sides; and wherein the right side of the at least one backboard member is removably attached with the back rest support portion of the right side support component, and the left side of the at least one backboard member is removably attached with the back rest support portion of the left side support component via elongated grooves-positioned in the back rest support portions of the right and left side support components enabled to accept the right and left sides of the backboard member, and wherein the backboard member may be removeably replaced without removing any other component.

9. The seating bench of claim 8 wherein the right and left side support components include suspension means attached with the left and right side support components to suspend the seating apparatus from a support frame.

10. The seating bench of claim 8 wherein the left side support component and the right side support component have legs which extend in a downward direction.

11. The seating bench of claim 8 wherein the left side support component and the right side support component are substantially identical.

12. The seating bench of claim 8 wherein theme design elements are included on an outside surface of the right side support member and the left side support member.

13. The seating bench of claim 8 wherein theme design elements are included on a front side of the backboard member.

14. The seating bench of claim 8, wherein theme design elements are included on a front board removably attached to a front edge of the horizontal seat component.

* * * * *